US006523192B1

(12) United States Patent
Gloodt

(10) Patent No.: US 6,523,192 B1
(45) Date of Patent: Feb. 25, 2003

(54) METHOD AND APPARATUS FOR AUTOMATICALLY DISINFECTING PLUMBING FIXTURES

(76) Inventor: Cary Gloodt, 2889 Springmeadow Ct., Indianapolis, IN (US) 46268

( * ) Notice: Subject to any disclaimer, the term of this patent is extended or adjusted under 35 U.S.C. 154(b) by 0 days.

(21) Appl. No.: 09/960,446

(22) Filed: Sep. 21, 2001

Related U.S. Application Data

(63) Continuation-in-part of application No. 09/849,659, filed on May 4, 2001, which is a continuation-in-part of application No. 09/544,157, filed on Apr. 6, 2000, now Pat. No. 6,279,177.

(51) Int. Cl.[7] ..... A47K 3/00

(52) U.S. Cl. ..... 4/541.1; 4/541.3; 4/541.5; 4/671; 4/688

(58) Field of Search ..... 4/541.1–541.5, 4/492, 679–685, 688–693, 671–673, 650–653, 668; 601/156–158; 137/602, 605

(56) References Cited

U.S. PATENT DOCUMENTS

| | | | | |
|---|---|---|---|---|
| 3,964,472 A | | 6/1976 | Nicollet | 128/66 |
| 4,237,562 A | | 12/1980 | DuPont | 4/543 |
| 4,563,781 A | | 1/1986 | James | 4/542 |
| 4,628,908 A | | 12/1986 | Dupont | 128/24.1 |
| 4,857,112 A | | 8/1989 | Franninge | 134/22.12 |
| 5,012,535 A | | 5/1991 | Klotzbach | 4/541 |
| 5,032,292 A | | 7/1991 | Conrad | 210/764 |
| 5,381,831 A | * | 1/1995 | Versland | 4/541.3 |
| 5,383,239 A | | 1/1995 | Mathis et al. | 4/541 |
| 5,720,905 A | | 2/1998 | Ho | 261/16 |
| 5,862,545 A | | 1/1999 | Mathis et al. | 4/662 |
| 5,865,601 A | | 2/1999 | Miller | 417/2 |
| 5,896,597 A | | 4/1999 | Kurth et al. | 4/541.6 |
| 6,122,775 A | * | 9/2000 | Jacuzzi et al. | 4/541.4 |
| 6,199,224 B1 | | 3/2001 | Versland | 4/541.4 |

FOREIGN PATENT DOCUMENTS

| | | | |
|---|---|---|---|
| EP | 0 519 572 | 12/1992 | A61H/33/00 |
| JP | 5-309052 | 11/1993 | A47K/3/00 |

OTHER PUBLICATIONS

Royal Spa Product Brochure, Royal Spa Manufacturing, 2041 West Epler Avenue, Indianapolis, Indiana 46217. Brochure circa Nov. 1998 showing whirlpool bathtub systems featuring aerated water jet nozzles.

* cited by examiner

*Primary Examiner*—Gregory L. Huson
*Assistant Examiner*—Tuan Nguyen
(74) *Attorney, Agent, or Firm*—C. John Brannon; Daniel L. Boots; Michael A. Myers

(57) ABSTRACT

A system for automatically purging residual water from the whirlpool plumbing of a whirlpool bath. The system includes a bathtub, a primary water inlet in hydraulic communication with the bathtub, a primary water outlet in hydraulic communication with the bathtub, a plunger actuatable to engage the primary water outlet to prevent water flow through the primary water outlet. When the bathtub is filled with water the plunger is automatically disengaged for a predetermined length of time to flush the water manifold, the water manifold conduit, the at least one water delivery conduit and the at least one jet nozzle. Also, when the bathtub is substantially drained, the air pump may be actuated to introduce air into the at least one jet nozzle, the at least one suction fitting, the water manifold, the at least one water delivery conduit, and the at least one hydraulic suction conduit to purge residual water therefrom.

8 Claims, 16 Drawing Sheets

METHOD AND APPARATUS FOR AUTOMATICALLY DISINFECTING PLUMBING FIXTURES

CROSS-REFERENCE TO RELATED APPLICATIONS

This application claims priority as a continuation-in-part to U.S. patent application Ser. No. 09/849,659, filed May 4, 2001, which is a continuation-in-part U.S. patent application Ser. No. 09/544,157, filed Apr. 6, 2000, now U.S. Pat. No. 6,279,177.

TECHNICAL FIELD OF THE INVENTION

The present invention relates generally to plumbing fixtures, and, more particularly, to a method and apparatus for automatically disinfecting water in the water lines, fixtures, and jet manifolds during filling and/or draining of the bathtubs, spa vessels, toilets, and/or urinals.

BACKGROUND OF THE INVENTION

A whirlpool bath or spa typically includes a tub in which the water is circulated around the bather to provide a relaxing and therapeutic environment. Whirlpool baths generally accomplish this through the use of a hydraulic pump to circulate water from the interior of the bathtub through plumbing located on the exterior of the bathtub and back into the tub through a plurality of nozzles. Whirlpool baths can be commonly found in homes, health clubs, hospitals, and rehabilitation centers.

One concern currently receiving some attention regarding the safety of whirlpool baths relates to sanitation. Specifically, there is a concern that it is difficult to completely drain all of the water from the whirlpool circulation plumbing, resulting in an environment conducive to the growth of bacteria and fungi. Since the plumbing is principally located outside of the bathtub (and is usually covered), the plumbing is generally inaccessible without undertaking the major effort of disassembling and removing the tub itself. The inaccessibility of the plumbing makes it nearly impossible to prevent standing water from being left therein after each use of the whirlpool bath. This is a problem because the standing water typically includes residual soap scum, scale deposits, sloughed off skin cells, body oils and other fluids, fecal matter, and other bathing residue. The plumbing therefore provides a dark, warm, and moist environment in which bacteria and fungi may thrive.

One recent study conducted by Dr. Rita Moyes of the Texas A&M University Department of Biology indicates that in addition to fungi, enteric organisms (Enterobacteriaceae), Pseudomonas sp., Legionella sp. (the causative agent of Legionnaire's disease and Pontiac fever) and Staphylococcus aureus may be found in such systems. "Microbial Loads in Whirlpool Bathtubs: An Emerging Health Risk" , Moyes, unpublished report. According to Dr. Moyes, these bacteria cause 30–35 % of all septicemias, more than 70 % of all urinary tract infections, impetigo, folliculitis, and carbuncles and have been implicated in infections of the respiratory tract, burn wounds, ears, eyes, and intestines. Id. S. Aureus is an etiological agent for bacteremia, endocarditis, pneumonia, empyema, osteomyletis, and septic arthritis and also releases a toxin responsible for scalded skin syndrome, toxic shock syndrome, and food poisoning. Id.

In a more general sense, other plumbing fixtures, such as standard bathtubs, toilets, urinals, wash basins and sinks all inherently include surfaces which periodically become wet during use and are concurrently exposed to bodily fluids and/or residues that generally include bacteria and other like hazards. Generally, these fixtures are not cleaned after each and every use and may provide environments where the above-mentioned bacteria may grow and thrive. The situation worsens in the case of publicly used fixtures, which are more frequently exposed to a much wider variety of pathogens and may be cleaned only infrequently.

One method known in the art of sanitizing plumbing fixtures is to completely drain and clean the circulation plumbing. However, complete draining of conventional plumbing fixtures can only be accomplished through their disassembly. Alternately, in the case of such fixtures as whirlpool bathtubs and toilets, sanitation of the plumbing has been attempted through the circulation of cleaning fluids therethrough, but this technique is largely ineffective without the use of expensive specialized equipment to heat, convey and concentrate special cleaning solutions therethrough. The simple surface application of disinfectants or cleaning solutions to fixture is very effective in sanitizing the so-treated surface, but is less effective in the sanitization of the interior plumbing and must be performed each time the fixture is used to be most effective.

Obviously, it would be desirable to routinely eliminate bacteria and other potentially dangerous pathogens from the plumbing fixtures as a matter of course each time the fixture is used. The present invention is directed toward achieving this goal.

SUMMARY OF THE INVENTION

The present invention relates to a method and apparatus for purifying and removing standing water from the plumbing in a whirlpool bath. One form of the present invention is a whirlpool bathtub having a water pump for circulating water in the whirlpool tub and a hydraulic plumbing system in hydraulic communication with the water pump. The hydraulic plumbing system includes a water inlet selectively actuatable to fill the whirlpool tub with water, a water drain system selectively actuatable to empty the whirlpool tub of water, at least one jet outlet nozzle, at least one suction inlet fitting, a first hydraulic plumbing subsystem connecting the at least one suction inlet fitting to the water pump, and a second hydraulic subsystem connecting the water pump to the at least one jet outlet nozzle. Actuation of the water inlet automatically actuates the water drain system for a predetermined period of time.

One object of the present invention is to provide an improved whirlpool bath system. Related objects and advantages of the present invention will be apparent from the following description.

DETAILED DESCRIPTION OF THE PREFERRED EMBODIMENT

Figure 1:
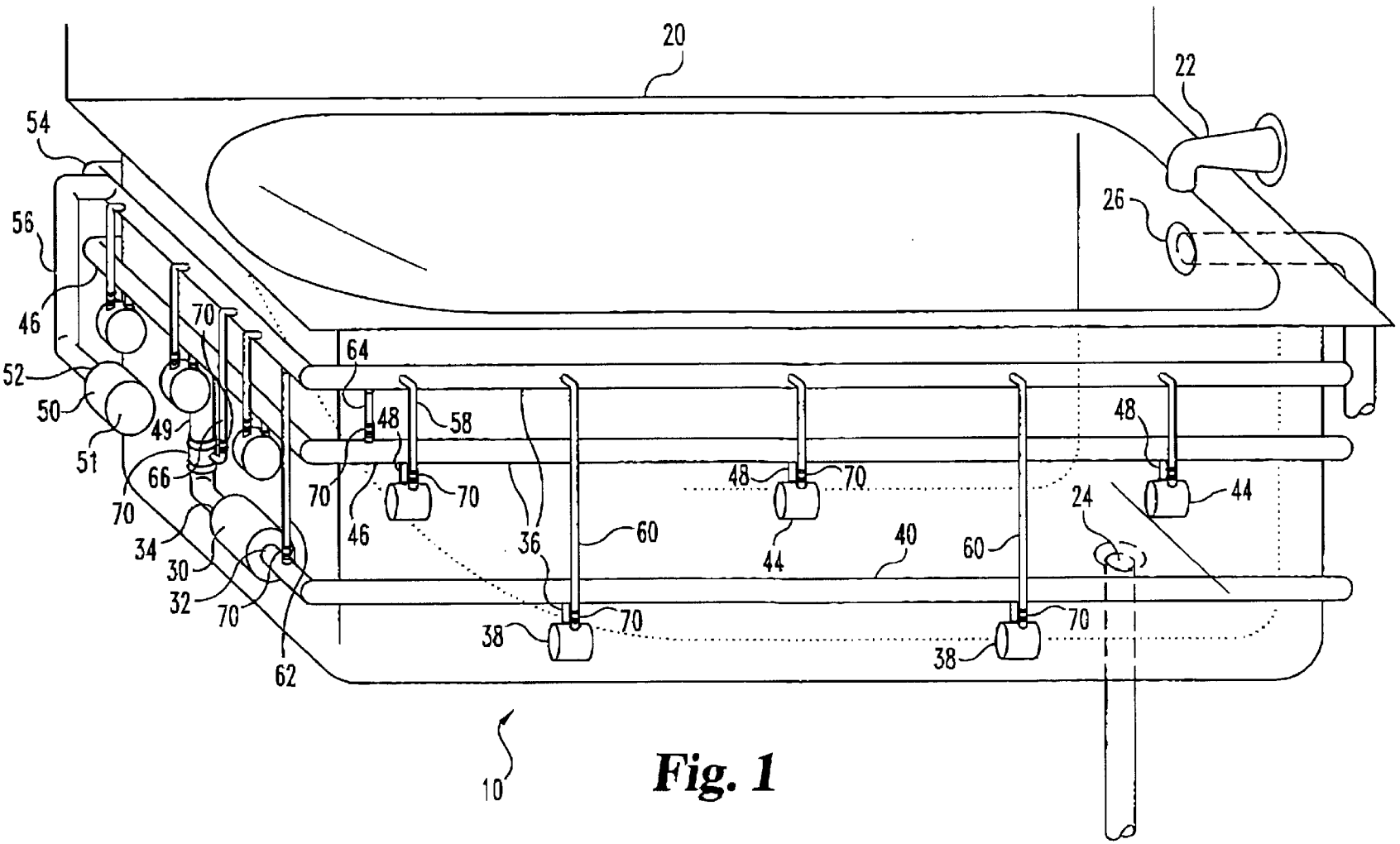
FIG. 1 is a perspective view of a first embodiment of a whirlpool bathtub fitted with a residual water purging system of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 2:
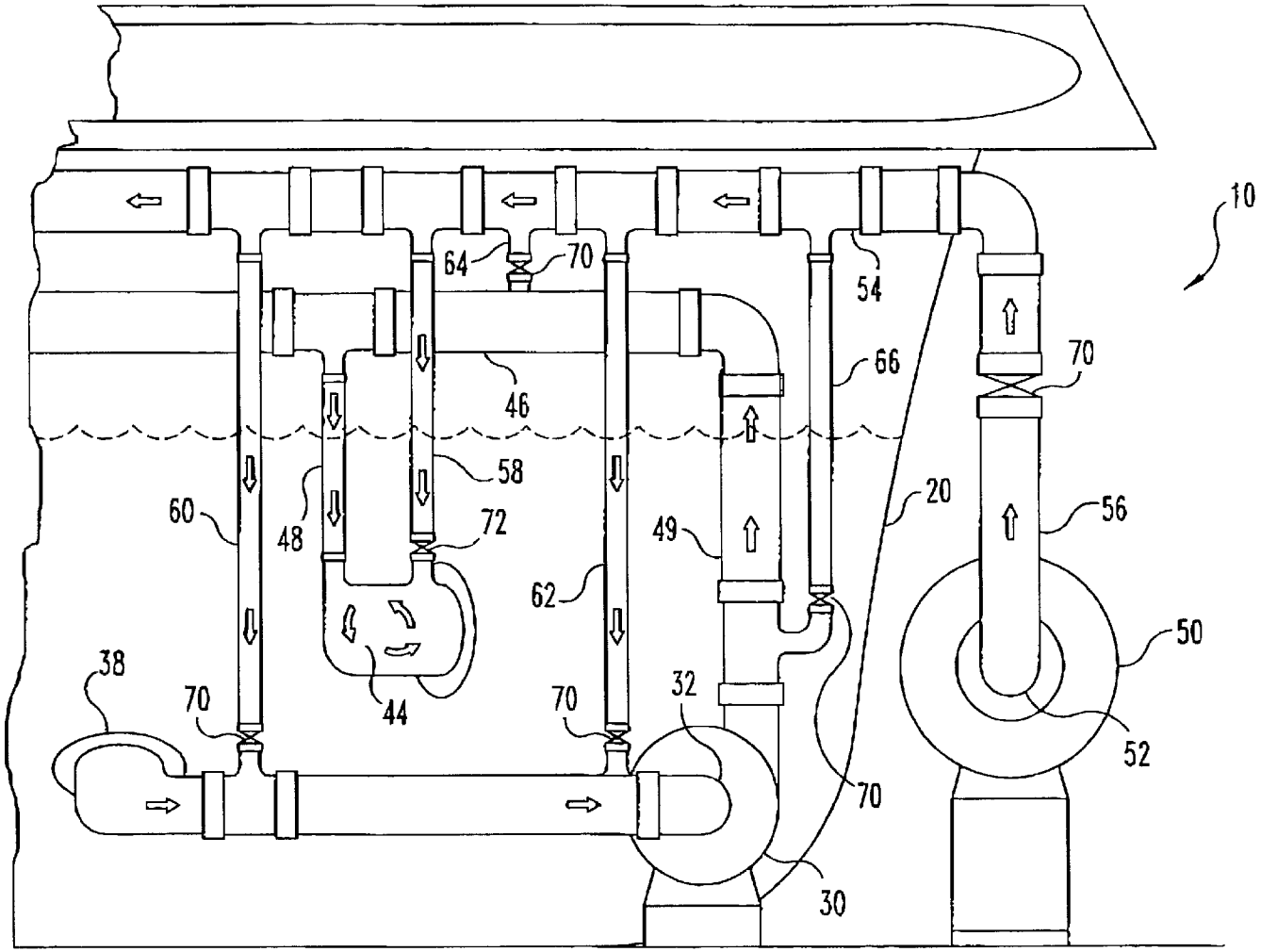
FIG. 2 is an enlarged partial perspective view of a portion of the embodiment of FIG. 1.

FIGS. 1 and 2 illustrate one embodiment of the present invention, a system 10 for purging residual water from the whirlpool plumbing of a whirlpool bathtub. The water purging system 10 is adapted to use air pressure to blow residual or standing water from the water circulation plumbing used to generate the "whirlpool" effect in a whirlpool bathtub 20. The whirlpool bathtub 20 typically includes a water inlet 22 and a water outlet or drain 24 connected to a central plumbing system. The whirlpool bathtub 20 preferably includes an auxiliary water outlet/drain 26 positioned substantially above the water drain 24. (As used herein, "above" means positioned farther away in a direction opposite the pull of gravity; a first object positioned "above" a second object of identical mass would have more gravitational potential energy and would have farther to fall before reaching a common gravitational source.) The auxiliary drain 26 functions to prevent an overflow of the bathtub 20, and effectively defines a maximum water level. However, the bathtub 20 may alternately include a single water drain 24 without an auxiliary drain 26.

A typical whirlpool bathtub 20 also includes a water pump 30 having a water pump inlet 32 and a water pump outlet 34. The water pump outlet 34 is connected in hydraulic communication with a whirlpool hydraulic system of plumbing 36 and is adapted to pump water therethrough when actuated while the bathtub 20 is filled with water.

The whirlpool hydraulic system 36 typically includes at least one suction fitting 38 formed through the bathtub 20. A suction conduit 40 extends from the suction fitting 38 to the water pump inlet 32, connecting the suction fitting 38 (and therethrough the bathtub 20) in hydraulic communication to the water pump 30. A plurality of water inlet or water jet nozzles 44 are also typically formed in the bathtub 20. A water manifold 46 is typically positioned around the bathtub 20 and is preferably positioned above the water level defined by the auxiliary drain 26. The water manifold 46 is connected in hydraulic communication to the plurality of water jet nozzles 44 by a plurality of water delivery conduits 48, each adapted to convey water from the water manifold 46 through the respective water jets 44 and into the bathtub 20. The water manifold 46 is also connected to the water pump outlet 34 by a water manifold conduit 49 extending therebetween in hydraulic communication. When actuated, the water pump 30 is adapted to receive water from the bathtub 20 through the suction fitting 38 and suction conduit 40 and return water under pressure into the bathtub 20 through the jet nozzles 44 by way of the water manifold 46.

The water purging system 10 of the present invention includes an air pump 50 having an air pump inlet 51 and an air pump outlet 52. The air pump outlet 52 is connected in pneumatic communication to an air manifold 54 through an air delivery conduit 56 extending therebetween. The air manifold 54 preferably extends around the bathtub 20 and is more preferably positioned above the water manifold 46. A plurality of air nozzle conduits 58 extend from the air manifold 54 to each respective water jet nozzle 44, connecting the air manifold 54 thereto in pneumatic communication. Preferably, an air suction fitting conduit 60 extends from the air manifold 54 to the suction fitting 38, connecting the air manifold 54 in pneumatic communication to the suction fitting 38. More preferably, an air suction conduit conduit 62, and air water manifold conduit 64 and an air water pump outlet conduit 66 extend between the air manifold 54 and the suction conduit 40, the water manifold 46, and the water pump outlet 34, respectively, connecting the air manifold 54 in pneumatic communication thereto. Still more preferably, the air manifold 54 is connected to the hydraulic plumbing system 36 through valves 70 (preferably check valves) adapted to allow air to flow into the hydraulic plumbing system 36 and to prevent water from flowing from the hydraulic plumbing system 36 into the air manifold 54. However, the air pump 50 may be coupled to the hydraulic plumbing system 36 in any convenient configuration that provides air pressure to the hydraulic plumbing system 36 sufficient to blow any standing water left in the hydraulic plumbing system 36 into the whirlpool bathtub 20 where it can be drained.

Figure 3:
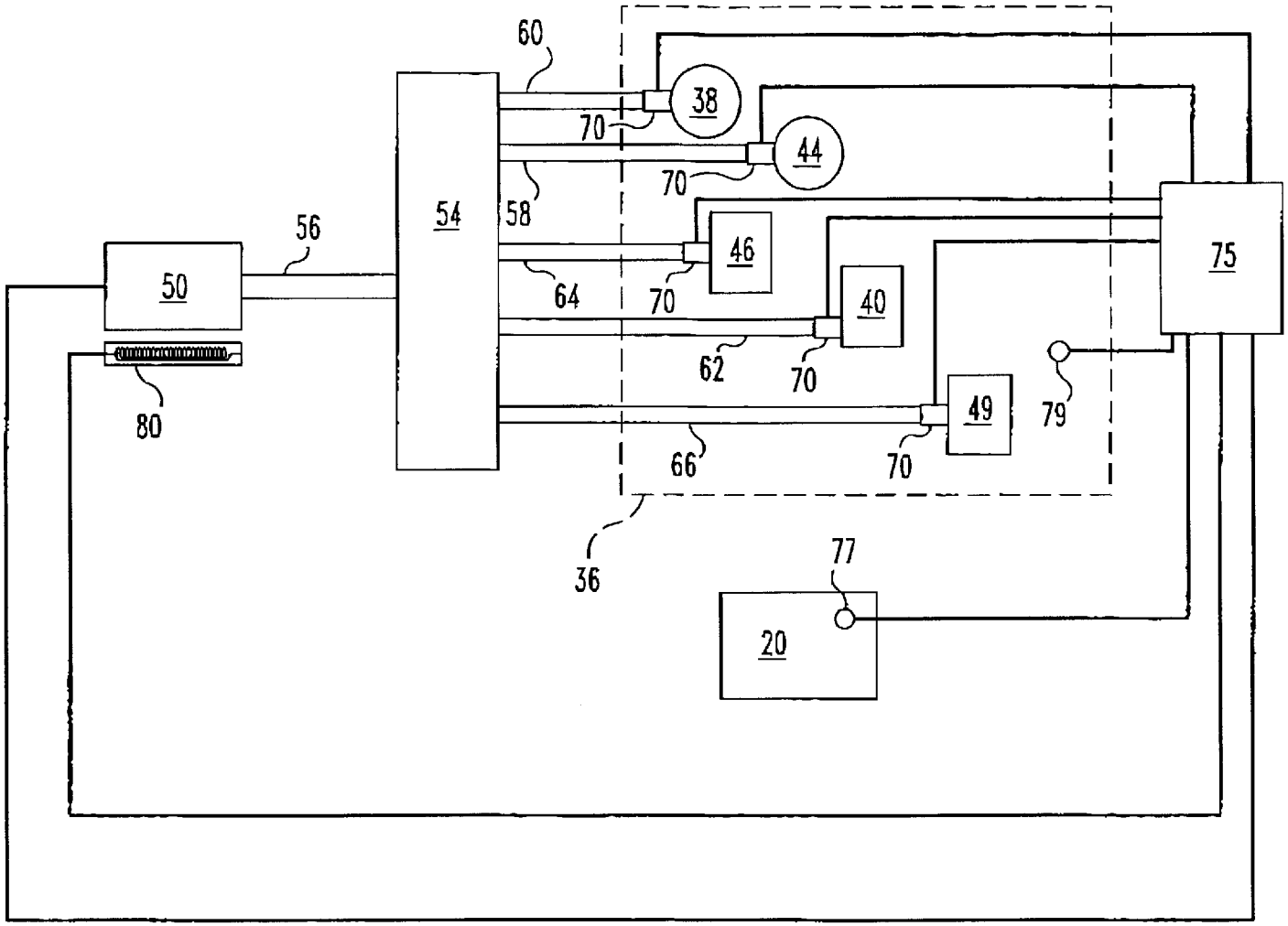
FIG. 3 is a schematic view of the embodiment of FIG. 1.

FIG. 3 schematically illustrates the whirlpool water purging system 10 of the present invention in greater detail. The air pump 50 is connected to the air manifold 54 through the air delivery conduit 56. The air manifold 54 is connected to one or more of the various components of the whirlpool hydraulic plumbing circuit 36 (including the suction fitting(s) 38, the suction conduit 40, the water jet nozzles 44, the water manifold 46, and/or the water manifold conduit 49) through one or more air conduits 58, 60, 62, 64 and 66. An electronic controller 75 may be operationally coupled to the air pump 50 to facilitate automatic or manual actuation thereof. For example, a sensor 77 may be positioned in the bathtub 20 and adapted to send a signal to the electronic controller when the bathtub 20 is drained or when the water temperature passes a predetermined threshold. Upon receipt of the signal, the electronic controller 75 activates the air pump 50 for a predetermined length of time. Alternately, a sensor 77 may be positioned in whirlpool hydraulic plumbing circuit 36 and adapted to send a signal to the electronic controller 75 in the presence of a predetermined amount of moisture. Upon receipt and for the duration of the signal, the electronic controller 75 actuates the air pump 50 to supply a stream of pressurized air flowing through the whirlpool hydraulic plumbing system 36.

The electronic controller 75 may also be operationally connected to a heater 80. The heater 80 is preferably positioned so as to be operationally coupled to the air pump 50, and is adapted to provide sufficient heat output to substantially heat the air flowing through the air pump 50 and through the air manifold 54, such that warm, dry air is provided to the whirlpool hydraulic plumbing system 36. The heater 80 may be slaved to the air pump 50 such that the heater 80 heats the air flowing through the air pump 50 whenever the air pump 50 is running. Alternately, the heater 80 may be independently controlled.

The electronic controller 75 may also be operationally coupled to any or all of the check valves 70, such that each of the check valves 70 may be independently operated. Independent operation of the check valves 70 allows the output of the air pump 50 to be concentrated as desired in the whirlpool hydraulic system 36. For example, while the bathtub 20 is filled with water, the check valves 70 connecting the air manifold 54 to the water inlet jets 44 may be opened and the remaining valves 70 may be closed, to concentrate the air flow through the water inlet jets 44. When the bathtub is drained, all of the check valves 70 may be opened to facilitate the rapid purging of water from the whirlpool hydraulic plumbing system 36. In one contemplated embodiment, a series of moisture sensors 77 may be positioned throughout the whirlpool hydraulic plumbing system 36 and operationally coupled to an electronic controller 75, such that the check valves 70 may be opened and closed to concentrate air flow through those portions of the hydraulic plumbing system 36 still containing moisture. In other words, the check valves 70 may be manipulated to maximize drying efficiency.

In operation, the water purging system 10 of the present invention supplies air pressure to the whirlpool hydraulic plumbing system 36 sufficient to purge remaining standing water left in the whirlpool hydraulic plumbing system 36. If the bathtub 20 is filled with water, actuation of the air pump 50 supplies pressurized air that may be used to aerate the water flowing through the water jet nozzles 44. When the water is substantially drained from the bathtub 20 and the whirlpool hydraulic plumbing system, actuation of the air pump 50 supplies pressurized air that may be directed through the whirlpool hydraulic plumbing system 36 to force substantially all of the residual water out of the hydraulic plumbing system 36. The air pump 50 may further be used to air dry the hydraulic plumbing system 36 by circulating a stream of pressurized air therethrough until the hydraulic plumbing system 36 is substantially dry. The effectiveness of the air-drying process may be enhanced by circulating heated air through the whirlpool hydraulic plumbing system 36.

The water purging system 10 of the present invention may be retrofitted to existing whirlpool hydraulic plumbing systems 36, or may be included therewith as part of a new whirlpool bathtub 20.

Figure 4:
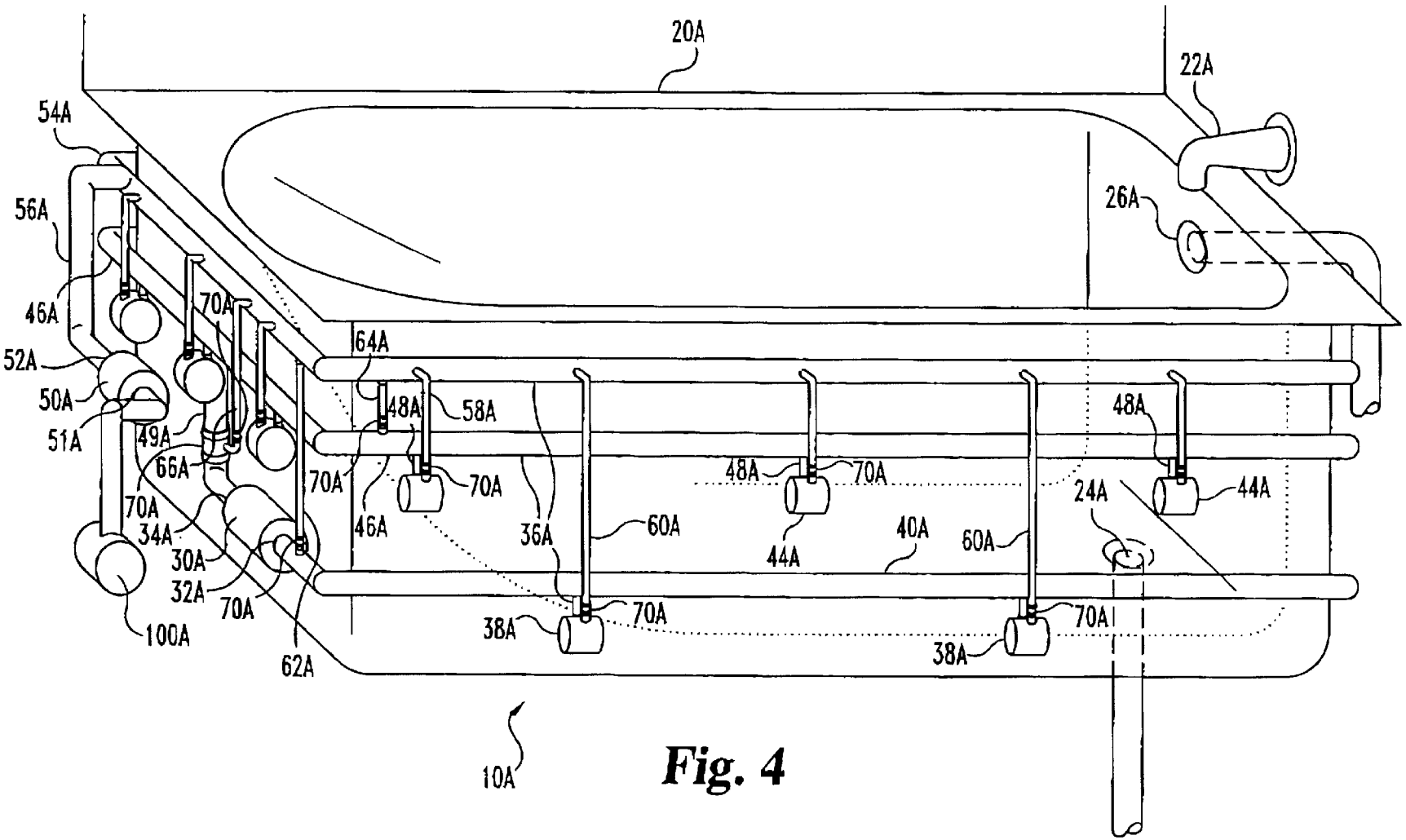
FIG. 4 is a perspective view of a second embodiment of a whirlpool bathtub fitted with a residual water purging and purifying system of the present invention.
Figure 5A:
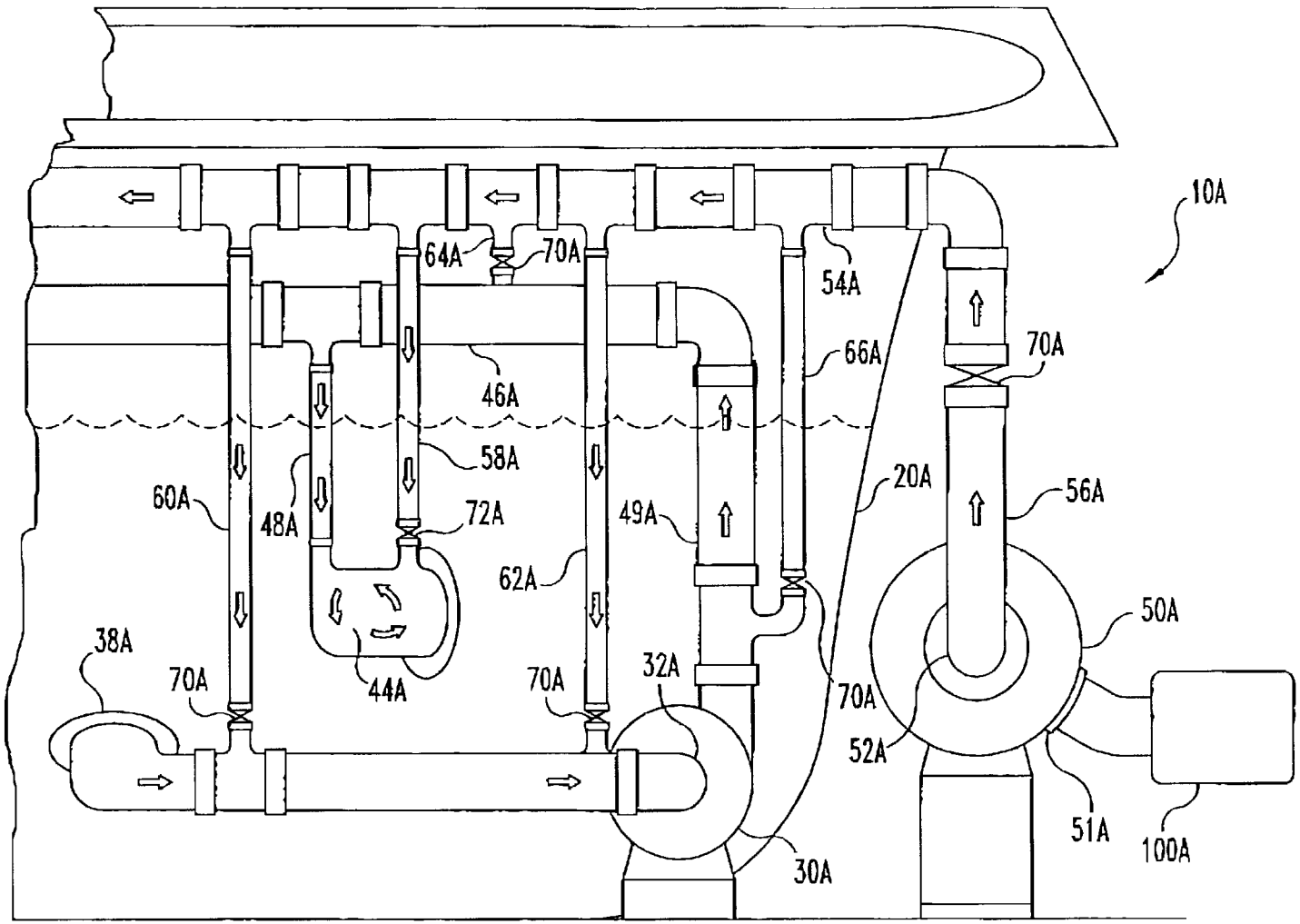
FIG. 5A is an enlarged partial perspective view of a portion of the embodiment of FIG. 4 with the ozone generator connected to the air pump inlet.
Figure 5B:
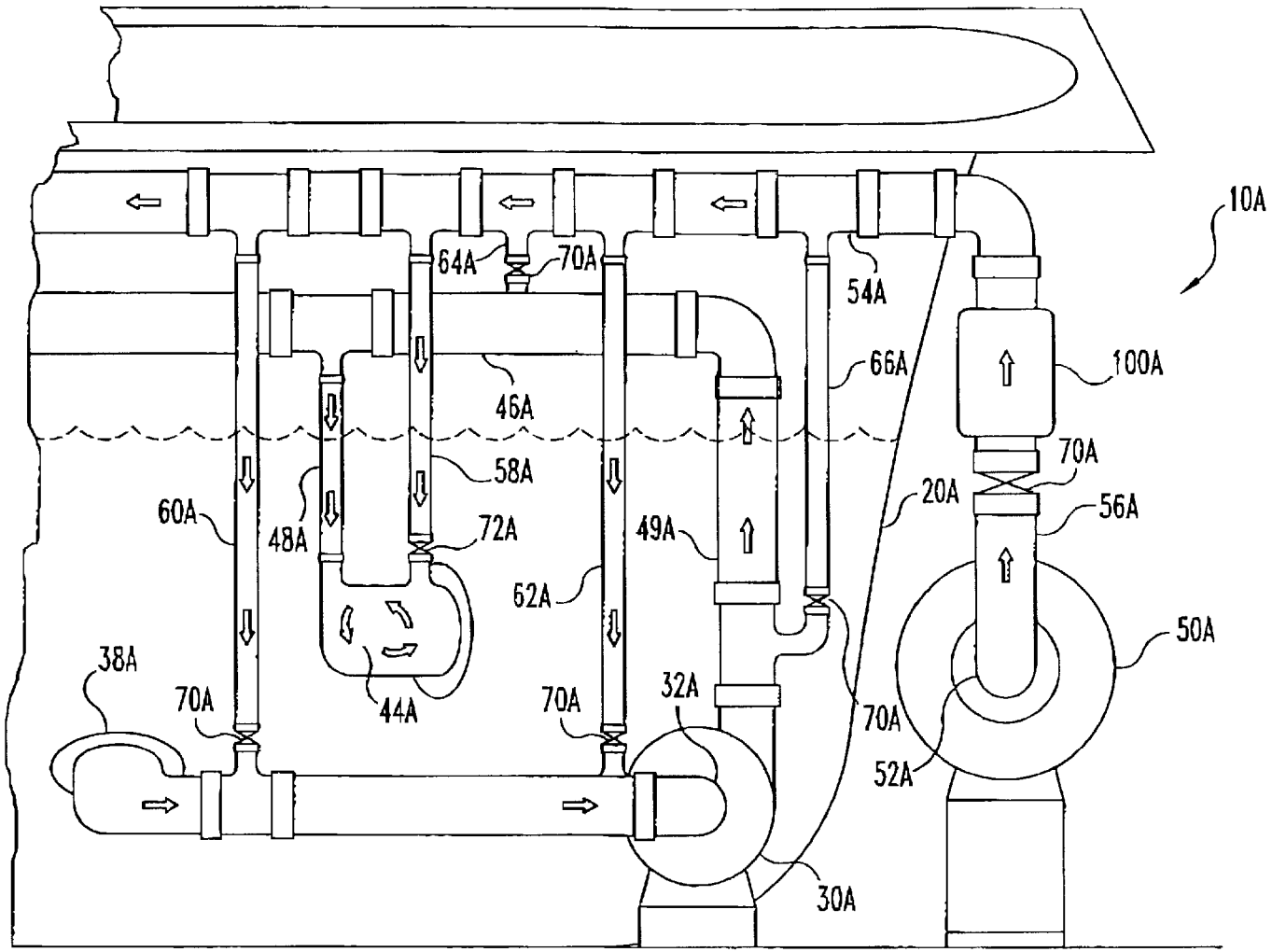
FIG. 5B is an enlarged partial perspective view of a portion of the embodiment of FIG. 4 with the ozone generator connected between the air manifold and the air pump.
Figure 6:
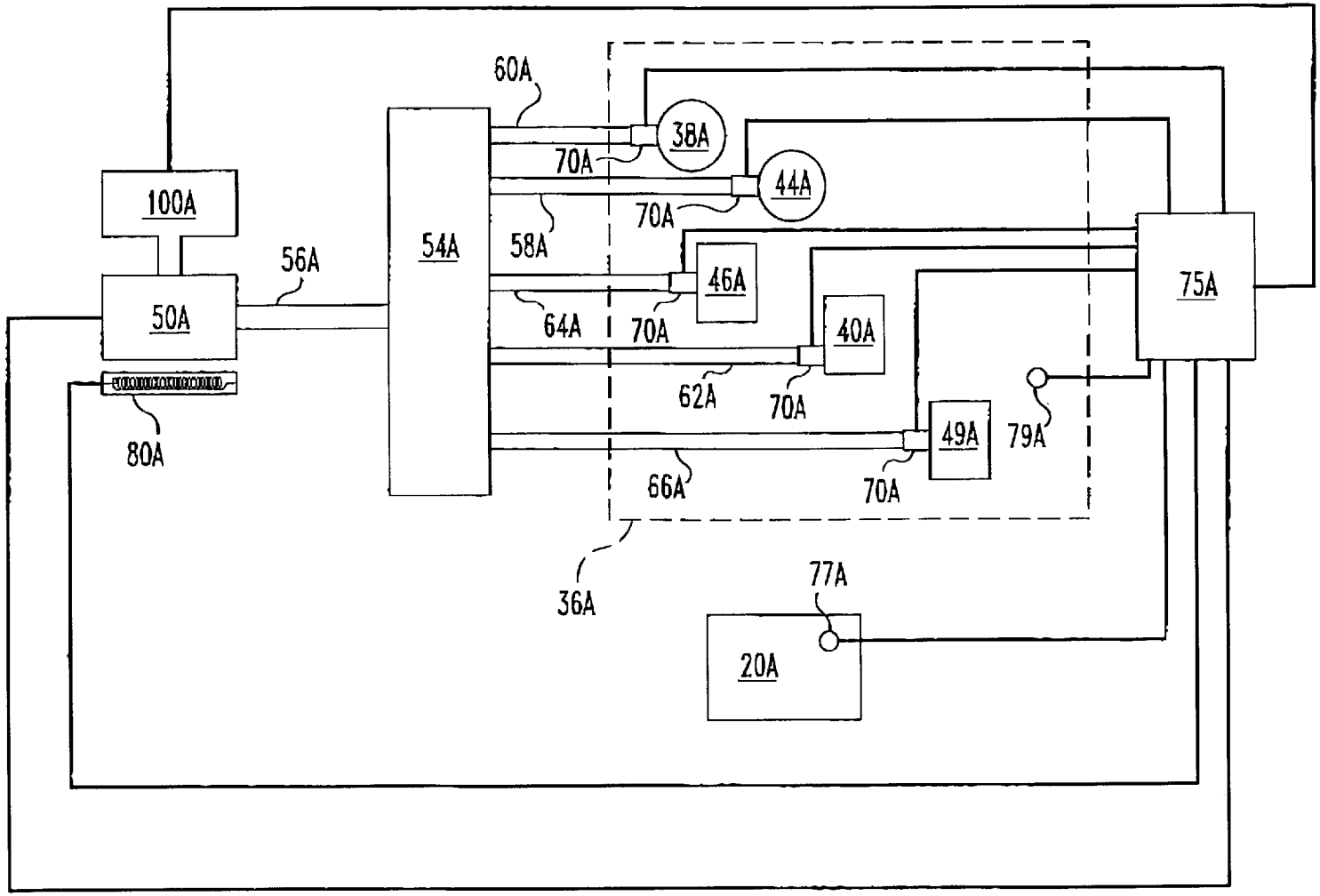
FIG. 6 is a schematic view of the embodiment of FIG. 4.

Another embodiment of the present invention is illustrated in FIGS. 4–6. FIGS. 4, 6A and 5B illustrate a water purging system 10A nearly identical to the one described above, with the addition of an ozone source 100A operationally connected to the air pump 50A. The ozone source 100A is preferably an ozone generator, but may also be an ozone tank or the like. The ozone generator 100A supplies ozonated air to the air pump 50A for circulation throughout the air manifold 54A, the air conduits 56A, 58A, and the hydraulic system 36A, including the water jet bodies 44A during the water purge operation. The ozone generator 100A may be pneumatically connected to the air pump inlet 51A (see FIG. 5A), or may be pneumatically connected upstream from the air pump 50A (see FIG. 5B), to provide ozone to all of the air flowing through the hydraulic plumbing system 36A and the water jet bodies 44A. The ozone generator 100A may therefore pneumatically communicate ozone to the air entering the air manifold 54A for redistribution throughout the rest of the water purging system 10A. Alternately, individual ozone generators 100A may be connected upstream and adjacent each water jet body 44A to further purify the air, water, and/or air/water mixture being expelled therefrom. These may be added in addition to or in place of the ozone generator 100A pneumatically connected to the air pump 50A discussed above. Preferably, the ozone generator 100A is connected to the electronic controller 75A, such that the ozone generator 100A may be actuated by the electronic controller 75A upon receipt of a signal from an operator or from a sensor 77A (for example, a water level sensor indicating that the tub 20A has been recently drained.) The ozone generator 100A may thus be actuated for a predetermined period of time (such as, for example, for the duration of the purging operation) by the electronic controller 75A.

Ozone is a well-known oxidant and disinfectant, and is commercially used in water purification and waste treatment facilities. The presence of ozone in the purging air helps to disinfect the air and water plumbing during the air purging operation. Further, the presence of ozone in the purging air also disinfects the air itself, reducing or eliminating airborne bacteria resulting from the air purging operation. Moreover, the interior of the tub may be shaped to direct the flow of ozonated water/air from the water jet bodies over the surface of the tub, to further disinfect the tub during/after use. Ozone may be injected into the air exclusively during the purging cycle, or at all times the air pump 50A is energized, since ozone is relatively harmless to people and in fact helps purify the water recirculated in the whirlpool bathtub 20A. Preferably, the ozone is introduced to the water purging system 10A upstream of the water jet bodies 44A. More preferably, ozone is introduced into the water purging system 10A upstream of the hydraulic plumbing system 36A.

Techniques for the generation of ozone are well known, any one of which may be utilized for the present ozone generator 100A. One commonly used technique is to irradiate oxygen molecules with very short wavelength high-energy ultraviolet (UV) radiation to cleave the oxygen molecules ($O_2$), producing lone ionized oxygen atoms (O), which combine with other $O_2$molecules to form ozone molecules ($O_3$). Another technique for producing ozone is to expose $O_2$ molecules to a high-energy electromagnetic field, such as a brush discharge, to cleave the $O_2$molecules for $O_3$ production. Heating the air to impart more energy to the $O_2$molecules increases the efficiency of ozone production independent of the ozone production method chosen. One commercially available device, the HYDRAZONE™ ozone generator, available from HYDRABATHS® of 211 S. Fairview Street, Santa Ana, Calif., combines the application of high-energy UV radiation with a high-energy electromagnetic field to efficiently produce ozone.

Figure 7:
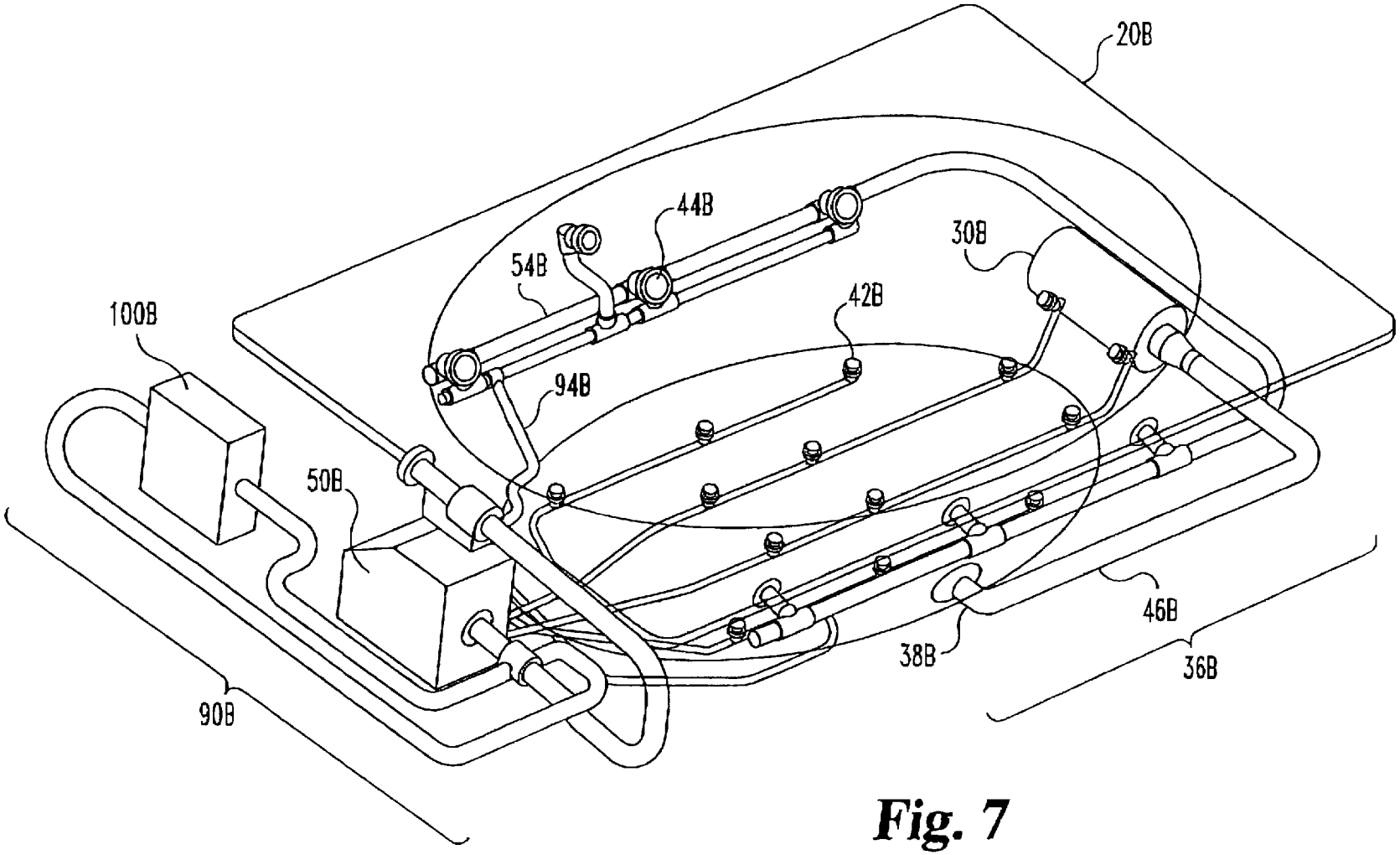
FIG. 7 is a perspective cut-away view of a third embodiment of the present invention.
Figure 8A:
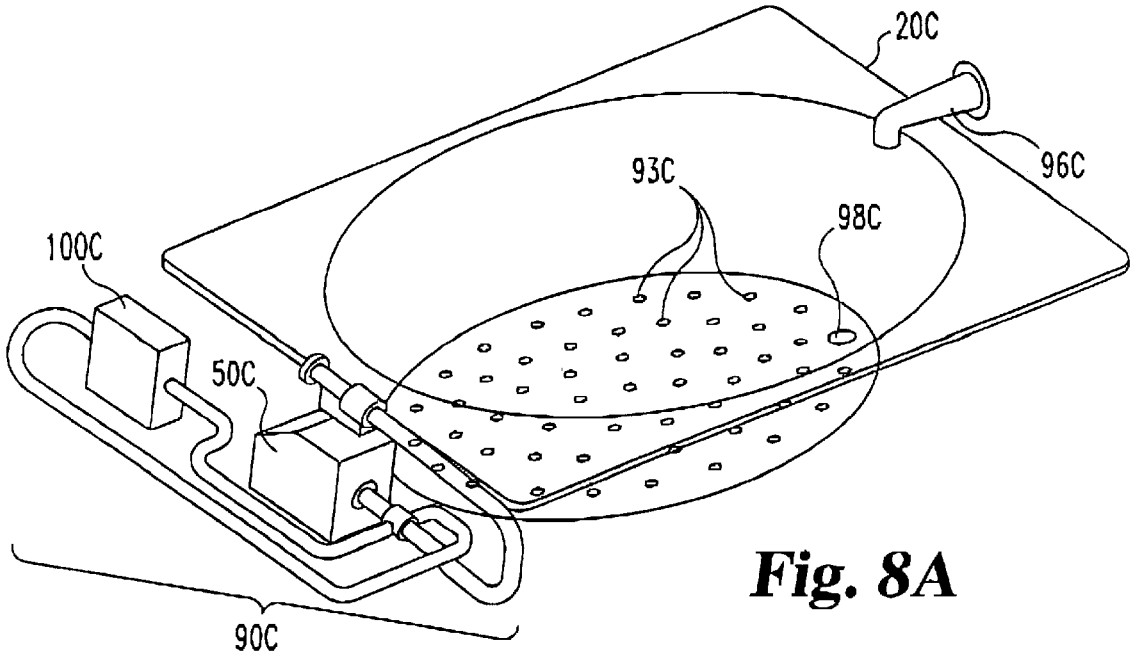
FIG. 8A is a perspective cut-away view of a fourth embodiment of the present invention.
Figure 8B:
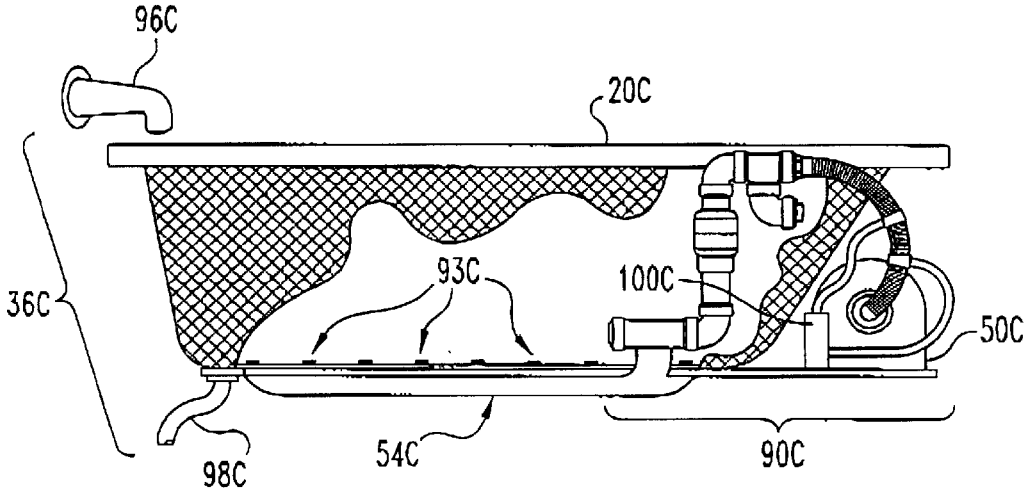
FIG. 8B is a side partial sectional view of the embodiment of FIG. 8A.
Figure 9A:
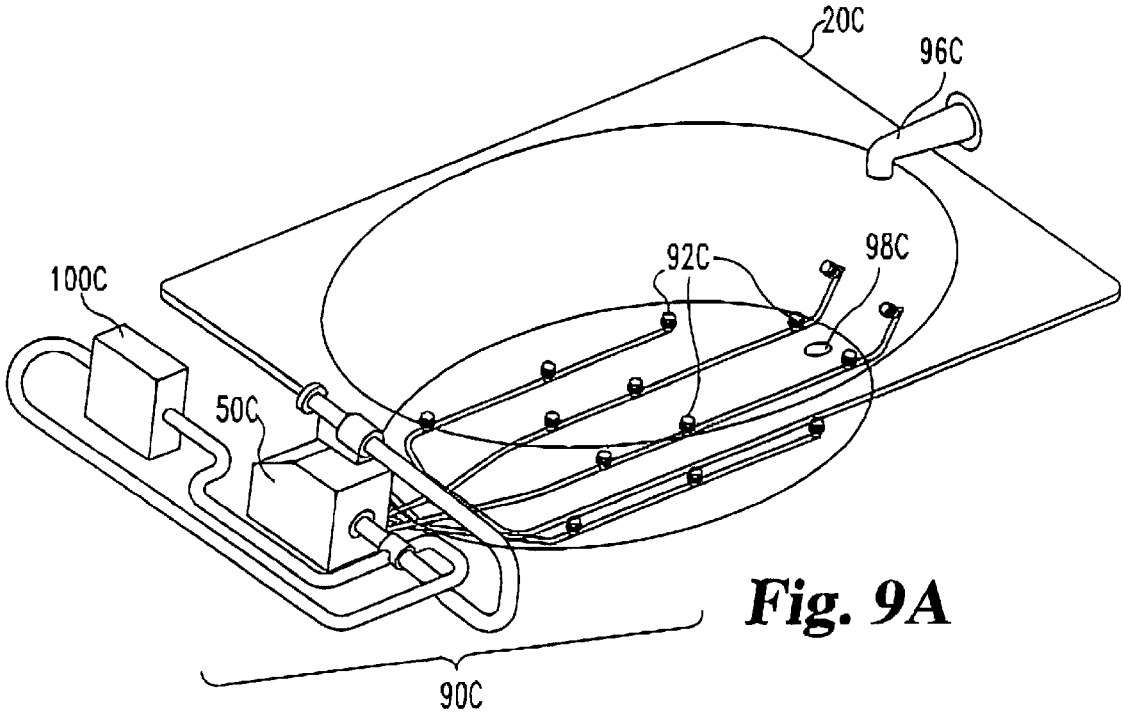
FIG. 9A is a perspective cut-away view of a fifth embodiment of the present invention.
Figure 9B:
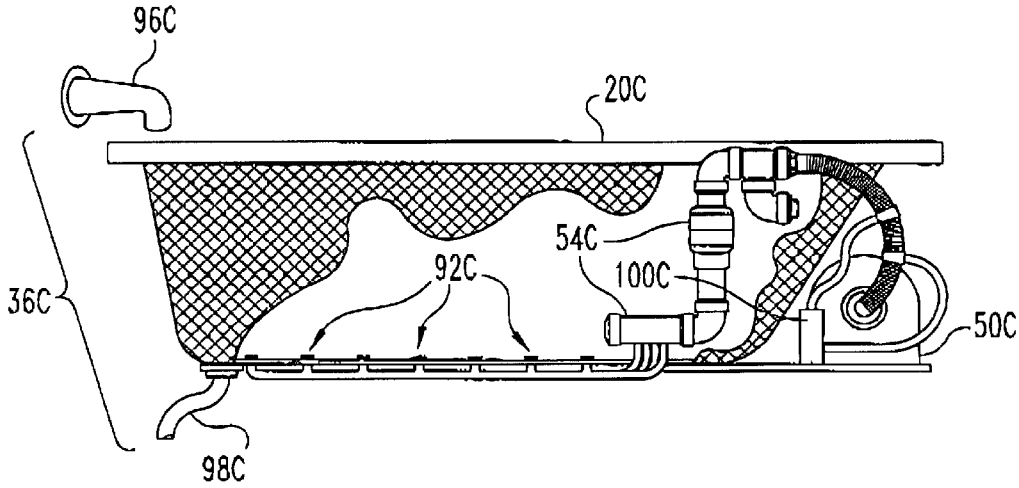
FIG. 9B is a side partial sectional view of the embodiment of FIG. 9A.

FIG. 7 illustrates still another embodiment of the present invention, a bathtub 20B having a hydraulic plumbing circuit 36B for circulating water therein and a pneumatic circuit 90B for bubbling air through water in the bathtub 20B. Hydraulic plumbing circuit 36B includes a water pump 30B connected in hydraulic communication (preferably through a water manifold 46B) with one or more jet bodies 44B to circulate water in the bathtub 20B. The water pump is also hydraulically connected to a suction inlet fitting 38B, such that water is transported from the bathtub 20B and recirculated thereinto by the water pump 36B through the jet bodies 44B.

The pneumatic circuit 90B includes a pneumatic pump or air blower 50B connected in pneumatic communication (preferably through an air manifold 54B) with a plurality of air jet bodies 92B positioned to open into or near the bottom of the bathtub 20B to bubble air through water contained therein. The air jet bodies 92B preferably include check valves to retard penetration of water thereinto. The pneumatic circuit 90B also includes an ozone generator 100B connected in pneumatic communication with the air blower 50B. The pneumatic circuit 90B further includes a pneumatic connection 94B between at least one element of the pneumatic circuit 90B, such as the air manifold 54B) and an element of the hydraulic circuit 36B (for instance, the water manifold 46B). The pneumatic connection 94B preferably includes a check valve to minimize water incursion into the pneumatic circuit 90B; likewise, the pneumatic circuit 90B is preferably substantially positioned above the hydraulic circuit 36B for the same reason).

When the bathtub 20B contains water, the hydraulic circuit 36B may be selectively activated to circulate water. Likewise, the pneumatic circuit 90B may be activated to bubble ozonated air through the water. Alternately, both circuits 46B, 90B may be simultaneously activated to circulate the water while ozonated air is bubbled therethrough. The passage of ozonated air through the pneumatic and hydraulic circuits 90B, 36B, the water in the bathtub 20B and over the surface of the bathtub 20B purifies and disinfects the air, water, and surfaces with which the ozone comes into contact.

FIGS. 8A, 8B, 9A, and 9B illustrate yet another embodiment of the present invention, a bathtub 20C having a pneumatic circuit 90C for bubbling air through water in the bathtub 20C. The pneumatic circuit 90C includes a pneumatic pump or air blower 50C connected in pneumatic communication (preferably through an air manifold 54C) with a plurality of air inlets, such as air jets 92C (see FIGS. 9A and 9B) or air holes 93C (see FIGS. 8A and 8B) positioned to open into or near the bottom of the bathtub 20C to bubble air through water contained therein. The air jets/holes 92C/93C preferably include check valves to retard penetration of water therethrough and into the air manifold 54C. The pneumatic circuit 90C also includes an ozone generator 100C connected in pneumatic communication with the air blower 50C.

The bathtub 20C also includes a hydraulic circuit 36C for filling the bathtub 20c with water and circulating water in the bathtub 20C. In this embodiment, the hydraulic circuit 36C includes a faucet 96C and a drain 24C. When the bathtub 20C contains water, the pneumatic circuit 90C may be activated to bubble ozonated air through the water. The passage of ozonated air through the pneumatic circuits 90C, through the water in the bathtub 20C and over the surface of the bathtub 20C purifies and disinfects the air, water, and surfaces with which the ozone comes into contact.

Figures 10A, 10B:
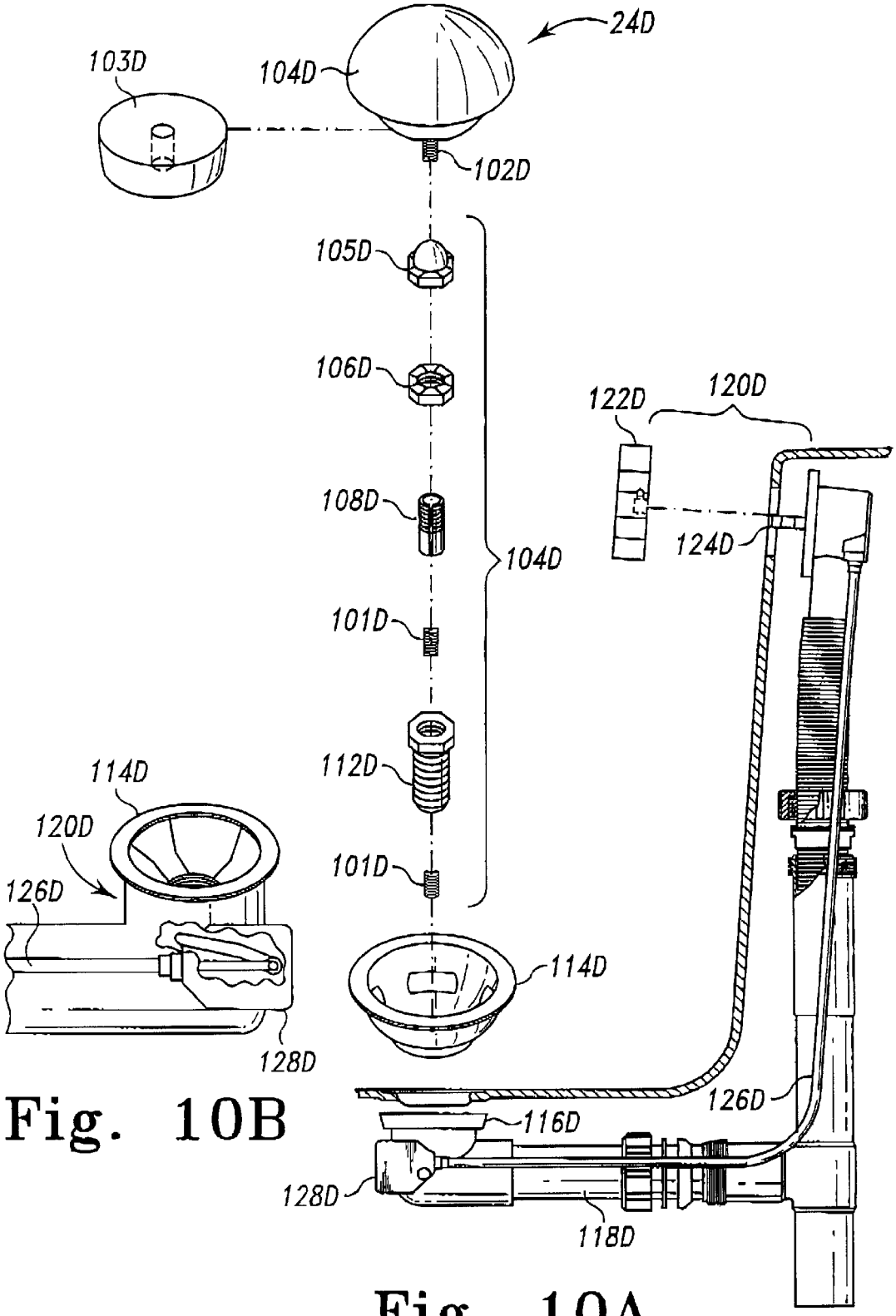
FIG. 10A is an exploded schematic view of a sixth embodiment of the present invention, a whirlpool bathtub having an automatically actuatable fill-flush system.
FIG. 10B is an enlarged partial cut-away view of the embodiment of FIG. 10A.

FIGS. 10A and 10B illustrate still another embodiment of the present invention, a whirlpool bathtub 20D similar to those illustrated above, but having a drain system 24D adapted to automatically open and remain open for a predetermined period each time the whirlpool bathtub 20D is filled. By remaining open at the beginning of the fill cycle, the drain system 24D allows any residual water or other material that may be present in the hydraulic circuit 36 to be flushed out and drained from the whirlpool bathtub 20D such that a bather is exposed to only fresh water.

The drain system 24D includes a weighted plunger 101D, which preferably includes an attached plunger weight 103D but may also be a unitary plunger piece 101D of substantial weight. The weight of the weighted plunger 101D is preferably between 1 and 2 pounds, but may be any weight sufficient to urge the weighted plunger 101D into the drain 24D. A plunger stem 1020D extends from the weighted plunger 101D. A sleeve assembly 104D is positioned below the weighted plunger 101D to receive the weighted plunger 101D. The sleeve assembly 104D includes a sleeve set nut 105D covering a sleeve tension adjuster 106D and attached to a (preferably nylon) sleeve 108D. The sleeve 108D is received in a hollow bolt 112D., and the plunger stem 1020D extends therethrough. The sleeve assembly 104D is connected to a slotted bath body flange or strainer 114D, which is in turn seated in a waste body 116D emptying into a drain pipe 118D. The weighted plunger 101D is seated in the bath body flange 114D, such that when the weighted plunger is raised, water may flow into and through the bath body flange 114D but when the weighted plunger is lowered, water is prevented from flowing through the bath body flange 114D.

The drain system 24D also includes a waste body camshaft lever mechanism 120D. An overflow camshaft actuator 122D is connected to an overflow camshaft 124D and adapted to be manually turned to rotate the overflow camshaft 124D. A control cable 126D is connected between the overflow camshaft 124D and a cover lever 128D pivotably connected to the waste body 116D, such that pivoting or turning of the overflow camshaft 124D pulls on the control cable 126D which pivots the cover lever 128D and raises the weighted plunger 101D. Unless held in a pivoted position, the overflow camshaft 124D is free to return to its unpivoted position, and is preferably biased to return to its unpivoted position. More preferably, the overflow cam shaft 124D may be operationally connected to the fill system such that turning the overflow camshaft 124D also actuates the filling of the bathtub 20.

Once raised, the weighted plunger 101D is urged to return to its lowered position seated in the bath body flange 114D by a combination of gravity and water pressure. The speed at which the weighted plunger 101D returns to its lowered, seated position is a primarily function of the weight of the weighted plunger 101D (which is generally considered to be a constant) and the tightness of the nylon sleeve 108D through which the plunger stem 1020D must travel. The tightness of the nylon sleeve 108D may be adjusted by the sleeve tension adjuster 106D, and is preferably preset to a tension corresponding to a predetermined desired period during which the weighted plunger 101D is raised above the bath body flange 114D, allowing water to drain therethrough. Preferably, the sleeve tension adjuster 106D is preset to impart a tension on the nylon sleeve 108D such that the predetermined lowering time of the weighted plunger 101D is 60 seconds. In other words, once the weighted plunger 101D is raised, the bathtub 20 begins to fill through the hydraulic system 36 while the drain remains open for 60 seconds (as it automatically closes) to allow any residual material in the hydraulic system 36 to be flushed out of the bathtub 20.

Figure 10C:
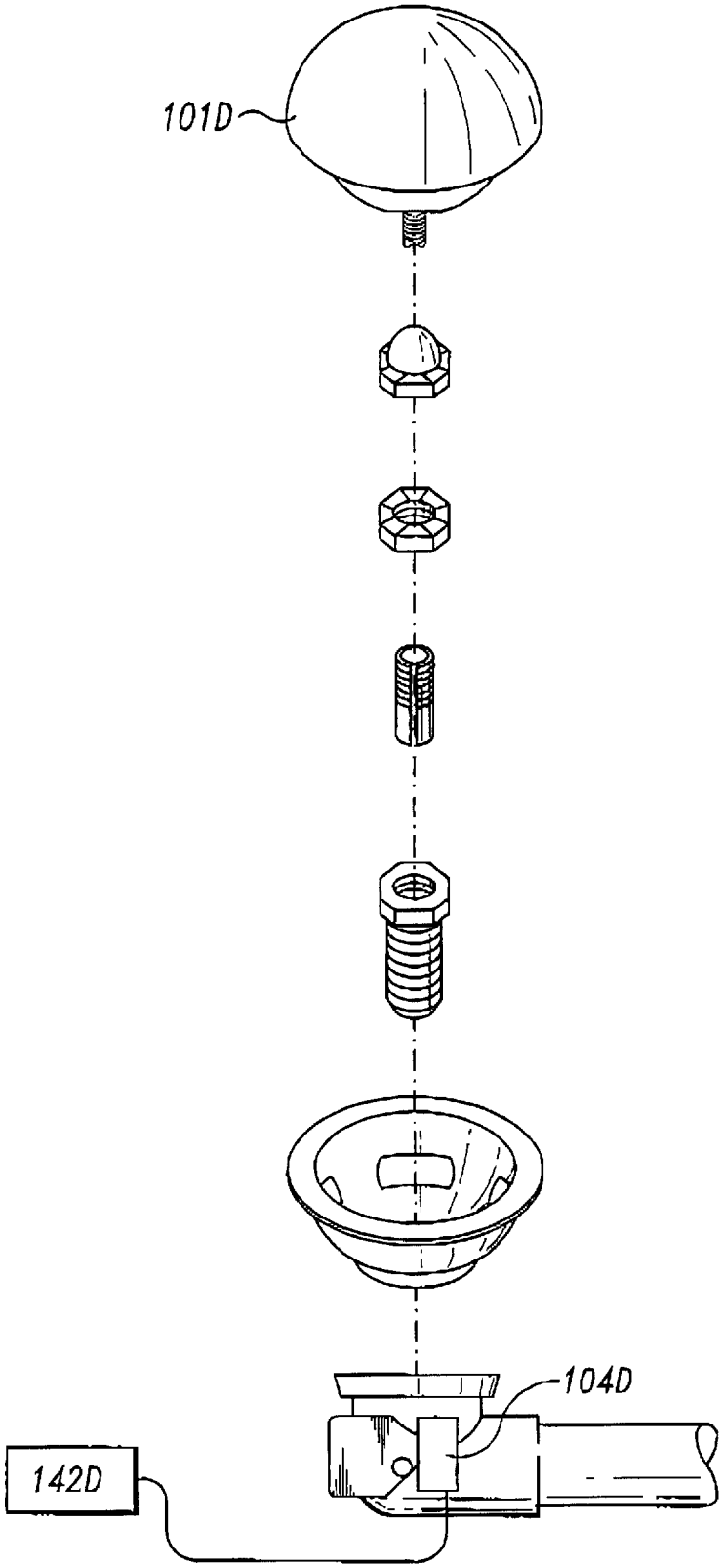
FIG. 10C is a schematic diagrammatic view of the embodiment of FIG. 10A including an electronic control system.
Figure 11A:
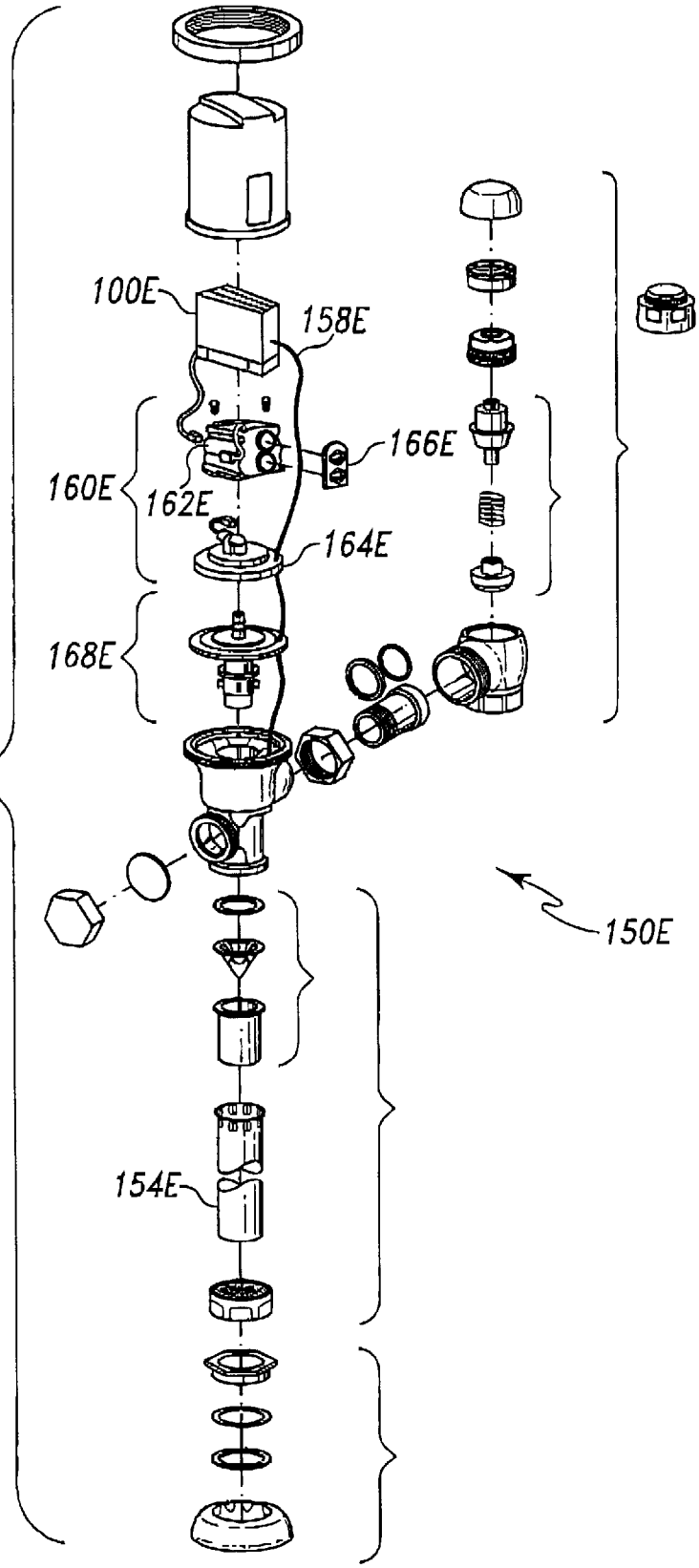
FIG. 11A is an exploded schematic view of a seventh embodiment of the present invention, a plumbing fixture having an ozone source operationally connected thereto and adapted to ozonate water entering the fixture.
Figure 11B:
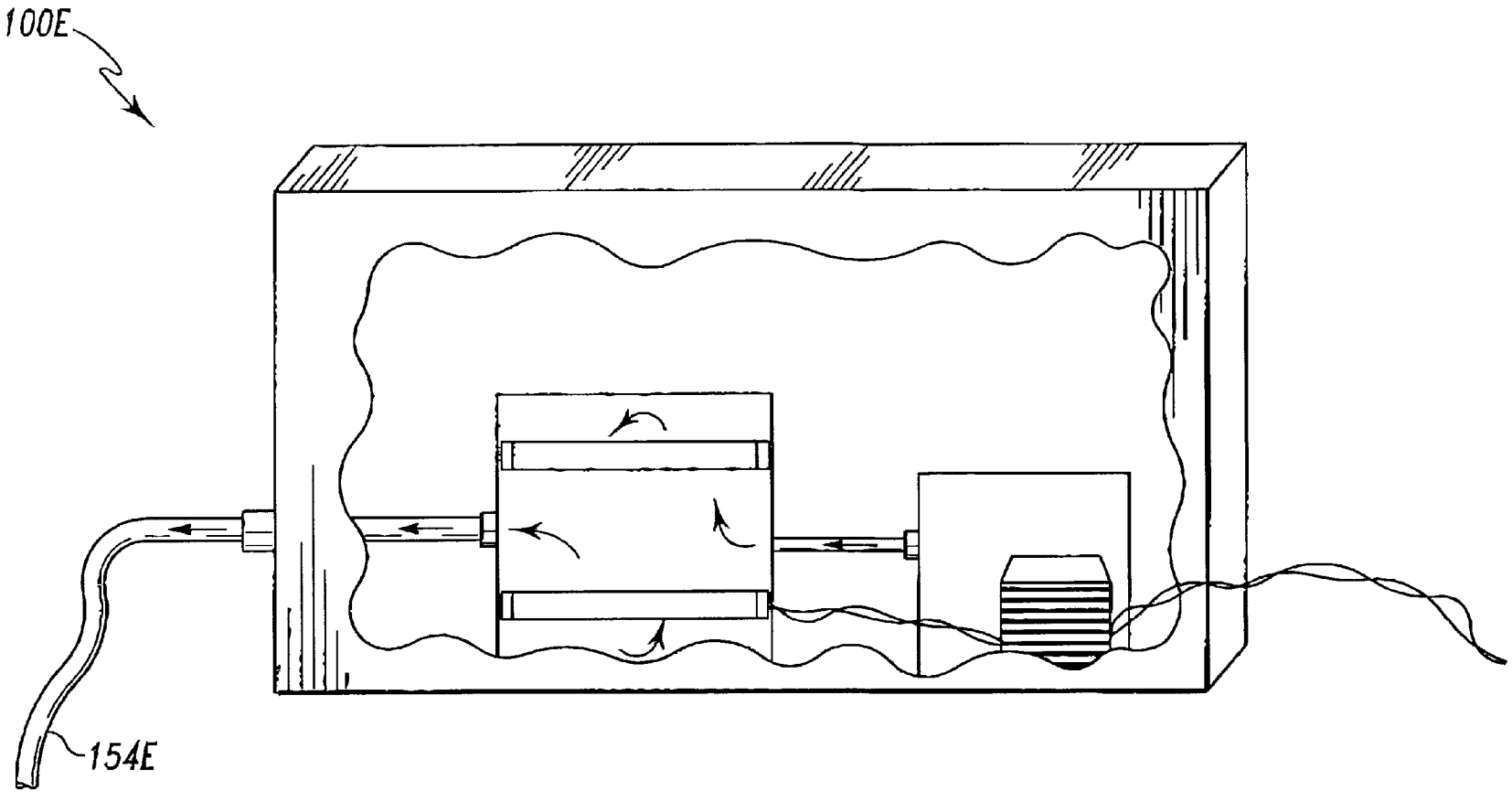
FIG. 11B is a partial cut-away schematic view of the ozone source of FIG. 11A.

In an alternate embodiment, as illustrated schematically in FIG. 10C, an electric solenoid motor 140D or the like may be used to lift and lower the weighted plunger 101D in response to an actuation signal. The solenoid may be connected to an electronic controller 142D programmed to open the drain system 24D for a predetermined amount of time (such as, for example, one minute) at the beginning of each fill cycle (i.e., each time the tub 20 is filled). The electronic controller 142D is preferably also operationally connected to the hydraulic system 36 such that the electronic controller 142D controls the filling, whirlpool, and draining functions of the tub 20.

Figure 12B:
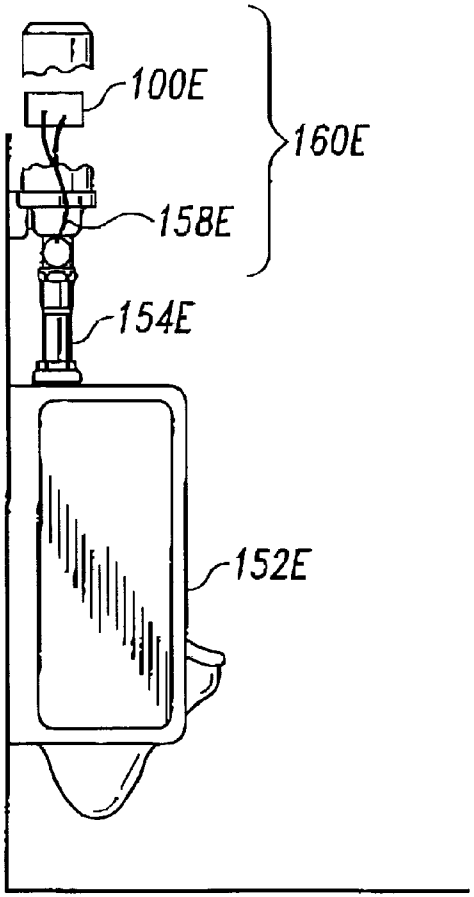
FIG. 12B is a side elevational view of the embodiment of FIG. 11A wherein the fixture is a urinal.
Figure 12A:
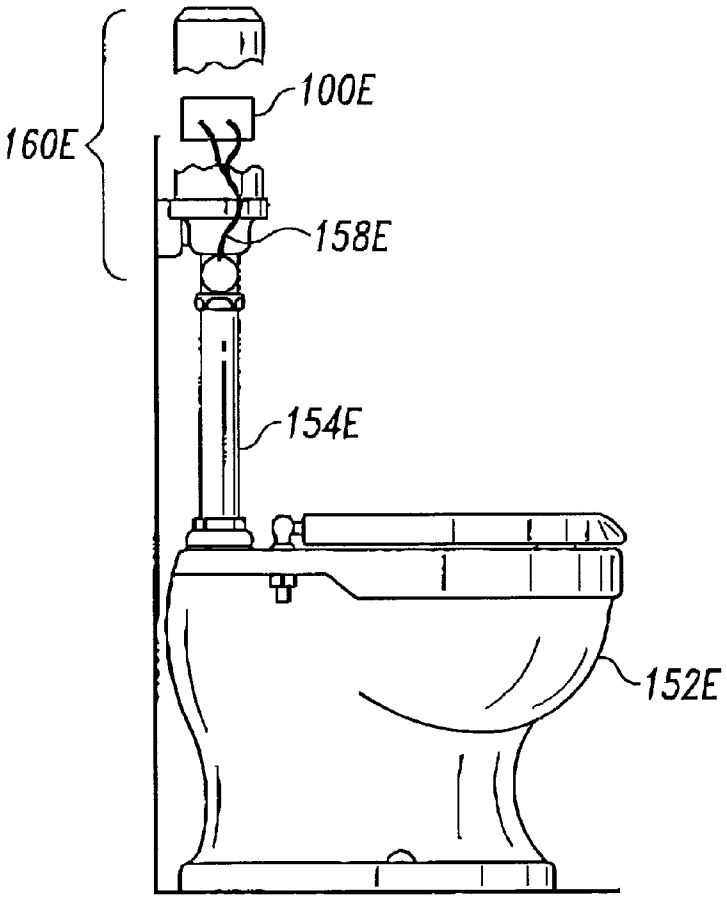
FIG. 12A is a side elevational view of the embodiment of FIG. 11A wherein the fixture is a toilet.

Referring to FIGS. 11A and 11B and 12A and 12B, yet another embodiment of the present invention is disclosed, an automatic ozonation system 150E for introducing ozonated air to plumbing fixtures 152E. The plumbing fixtures 152E illustrated in FIGS. 12A and 12B are a toilet and a urinal, respectively, but may be any plumbing fixtures. The automated ozonation system includes a water inlet pipe 154E through which water flows into the plumbing fixture 152E. An ozonator 100E is operationally connected to the water inlet pipe 154E such that air is pumped through the ozonator 100E, at least some of the oxygen in the air is converted to ozone, and the ozone-enriched air is then introduced into the water flowing through the inlet pipe 154E. Preferably, the oxonator 100E includes an air tube 158E directing ozonated air from the ozonator 100E into the inlet pipe 154E. The air tube 158E preferably includes a plurality of perforations or apertures through which ozonated air may be introduced into the water flowing throughout a length of the inlet pipe 154E, but may alternately terminate in a single opening or may even be closed-ended and made of an air permeable material.

Preferably, the automatic ozonation system 150E also includes an automatic flush system 160E and more preferably includes a battery pack 162E electrically connected to the ozonator 100E. The automatic flush system also preferably includes a solenoid 164E operationally connected between an electronic sensor 166E (such as a motion or proximity detector) and a valve assembly 168E. Preferably, the automatic ozonation system is configured to energize the solenoid 164E and the ozonator 100E simultaneously upon reception of a signal from the sensor 166E. The ozonator 100E then pumps ozonated air into the flowing water, enriching the water with ozone before the water is introduced into the plumbing fixture 152E. However, the ozonator 100E may be powered by any convenient power source, such as line current. Also, the ozonator 100E may be configured to ozonate the water in a reservoir or for at predetermined intervals and/or for predetermined periods of time.

Figure 13:
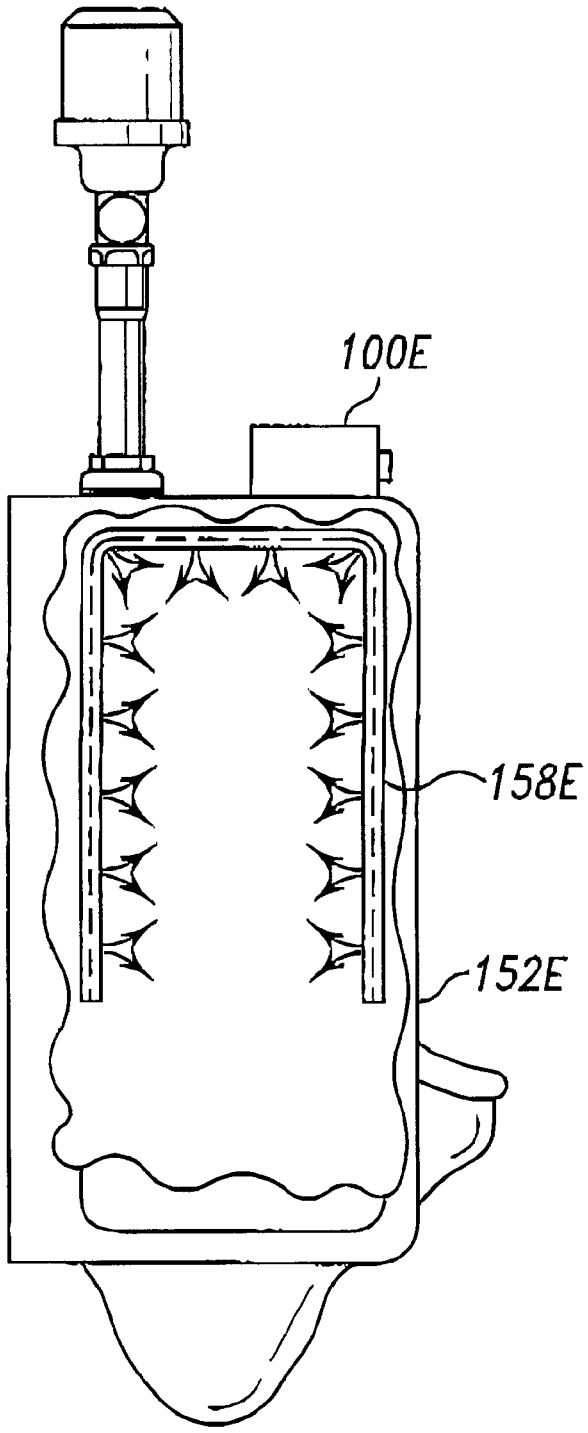
FIG. 13 is a front elevational view of an eighth embodiment of the present invention, a plumbing fixture having an ozone source operationally connected thereto and adapted to directly ozonate the fixture.

In an alternate embodiment, as illustrated in FIG. 13,an ozonator 100E may be adapted to supply ozonated air directly onto the surface of a plumbing fixture 152E. The air tube 158E is directed to expel ozonated air directly onto the surface of the plumbing fixture 152E. Preferably, the air tube 158E is sufficiently perforated to direct ozonated air evenly over the entire surface of the plumbing fixture 158E.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A system for automatically purging residual water from the whirlpool plumbing of a whirlpool bath, comprising:

a bathtub;

a primary water inlet in hydraulic communication with the bathtub;

a primary water outlet in hydraulic communication with the bathtub;

a plunger actuatable to engage the primary water outlet to prevent water flow through the primary water outlet;

an auxiliary water outlet in hydraulic communication with the bathtub and positioned to define a maximum water level;

a hydraulic pump having a water outlet port and a water inlet port;

an air pump having an air inlet port and an air outlet port;

at least one suction fitting formed in the bathtub;

at least one hydraulic suction conduit extending between the at least one suction fitting to the water inlet port and connecting the at least one suction fitting in hydraulic communication to the water inlet port;

at least one jet nozzle formed in the bathtub;

a water manifold substantially positioned above the maximum water level;

a water manifold conduit extending between the water outlet port and the water manifold and connecting the water outlet port to the water manifold in hydraulic communication therewith;

at least one water delivery conduit extending between the water manifold and the at least one jet nozzle and connecting the water manifold to the at least one jet nozzle in hydraulic communication therewith;

an air manifold positioned above the water manifold;

an air pump delivery conduit extending between the air pump outlet and the air manifold and connecting the air pump outlet in pneumatic communication with the air manifold;

at least one air nozzle conduit extending between the air manifold and the at least one jet nozzle and connecting the air manifold in pneumatic communication to the at least one jet nozzle;

at least one air suction conduit extending between the air manifold and the at least one suction fitting and connecting the air manifold in pneumatic communication to the at least one suction fitting;

wherein when the bathtub is being filled with water, the plunger is automatically disengaged for a predetermined length of time to flush the water manifold, the water manifold conduit, the at least one water delivery conduit and the at least one jet nozzle; and wherein when the bathtub is substantially drained, the air pump may be actuated to introduce air into the at least one jet nozzle, the at least one suction fitting, the water manifold, the at least one water delivery conduit, and the at least one hydraulic suction conduit to purge residual water therefrom.

2. The system of claim 1 further comprising an ozone supply in pneumatic communication with the air pump.

3. The system of claim 1 wherein the plunger is substantially weighted and further comprising a sleeve assembly operationally connected to the plunger, wherein upon actuation of the plunger the sleeve assembly delays engagement of the plunger with the primary water outlet for a predetermined length of time.

4. The system of claim 1 further comprising a servo operationally connected to the plunger and adapted to selectively engage and disengage the plunger with the primary water outlet; and a sensor positioned to detect when the bathtub is being filled; and an electronic controller operationally connected to the sensor and to the servo; wherein the electronic controller is adapted to actuate the servo to disengage the plunger from the primary water outlet to allow water to flow therethrough for a predetermined period of time upon receiving the signal from the sensor and wherein the electronic controller is adapted to actuate the servo to engage the plunger to the primary water outlet to block further flow of water therethrough after the predetermined period of time has elapsed.

5. The system of claim 4 wherein the predetermined period of time is sixty seconds.

6. A whirlpool system, comprising;

a water pump for circulating water in a whirlpool tub;

a hydraulic plumbing system in hydraulic communication with the water pump, the hydraulic plumbing system comprising:

at least one jet outlet nozzle;

at least one suction inlet fitting;

a first hydraulic plumbing subsystem connecting the at least one suction inlet fitting to the water pump; and a second hydraulic subsystem connecting the water pump to the at least one jet outlet nozzle;

a water inlet hydraulically connected to the whirlpool tub;

a water inlet valve adapted to selectively allow water through the water inlet;

a water drain;

a water drain cap selectively engageable to prevent water flow through the water drain;

an air manifold positioned adjacent the hydraulic plumbing system;

an air pump adapted to provide positive air pressure to the hydraulic plumbing system connected in fluid communication with the hydraulic plumbing system; and at least one air suction conduit extending from the air manifold and connecting between the at least one suction inlet fitting and the water pump to connect the air manifold in pneumatic communication to the at least one suction inlet fitting; and wherein when the whirlpool is being filled with water, the water drain cap is automatically disengaged for a predetermined length of time to flush the hydraulic plumbing system; and wherein the water drain cap is automatically engaged to prevent the flow of water through the water drain after the predetermined length of time has elapsed.

7. The whirlpool system of claim 6 further including a water drain cap servo operationally connected to the water drain cap and adapted to selectively engage and disengage the water drain cap with the water drain; a water inlet valve servo operationally connected to the water inlet valve; and an electronic controller operationally connected to the water inlet valve servo and to the water drain cap servo; wherein the electronic controller is adapted to actuate the water inlet valve servo to fill the tub; and wherein the electronic controller is further adapted to actuate the water drain cap servo to temporarily disengage the water drain cap from the water drain for a predetermined period of time and then actuate the water drain cap servo to engage the water drain cap to the water drain after the predetermined period of time has elapsed when the water inlet valve is opened.

8. A whirlpool system, comprising;

a water pump for circulating water in a whirlpool tub;

a hydraulic plumbing system in hydraulic communication with the water pump, the hydraulic plumbing system comprising:

at least one jet outlet nozzle;

at least one suction inlet fitting;

a first hydraulic plumbing subsystem connecting the at least one suction inlet fitting to the water pump; and a second hydraulic subsystem connecting the water pump to the at least one jet outlet nozzle;

a water inlet selectively actuatable of fill the whirlpool tub with water;

a water drain system selectively actuatable to empty the whirlpool tub of water, the drin system comprising:

a water drain;

a water drain cap selectively engageable to prevent water flow through the water drain;

wherein when the whirlpool is being filled with water, the water drain cap is automatically disengaged for a predetermined length of time to flush the hydraulic plumbing system; and wherein the water drain cap is automatically engaged to prevent the flow of water through the water drain after the predetermined length of time has elapsed.

* * * * *